US009170001B2

(12) United States Patent
Schenkl

(10) Patent No.: US 9,170,001 B2
(45) Date of Patent: Oct. 27, 2015

(54) LIGHT EMITTING DEVICE FOR A DRUM OF A HOUSEHOLD APPLIANCE

(75) Inventor: Johann Schenkl, Bodenwohr (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 782 days.

(21) Appl. No.: 13/386,745

(22) PCT Filed: Jul. 27, 2010

(86) PCT No.: PCT/EP2010/004599

§ 371 (c)(1),
(2), (4) Date: Jan. 24, 2012

(87) PCT Pub. No.: WO2011/012292

PCT Pub. Date: Feb. 3, 2011

(65) Prior Publication Data

US 2012/0120667 A1 May 17, 2012

(30) Foreign Application Priority Data

Jul. 27, 2009 (DE) ..... 10 2009 034 841

(51) Int. Cl.

| | |
|---|---|
| ***F21V 5/04*** | (2006.01) |
| ***F21V 19/02*** | (2006.01) |
| ***D06F 37/26*** | (2006.01) |
| ***F21V 5/02*** | (2006.01) |

(Continued)

(52) U.S. Cl.

CPC ..... *F21V 19/02* (2013.01); *D06F 37/266* (2013.01); *F21V 5/02* (2013.01); *F21V 5/04* (2013.01); *F21V 13/02* (2013.01); *F21V 31/005* (2013.01); *F21V 33/0044* (2013.01); *F21V 17/06* (2013.01); *F21V 17/164* (2013.01); *F21V 19/001* (2013.01); *F21W 2131/30* (2013.01); *F21Y 2101/02* (2013.01)

(58) Field of Classification Search

CPC ..... F21V 5/043; F21V 5/08; F21V 5/007; F21V 5/008; F21W 2131/30; D06F 37/02

USPC ..... 362/335, 351

See application file for complete search history.

(56) References Cited

U.S. PATENT DOCUMENTS 4,733,335 A * 3/1988 Serizawa et al. ..... 362/503
5,704,704 A * 1/1998 Reichard et al. ..... 362/477

(Continued)

FOREIGN PATENT DOCUMENTS

DE 3843386 A * 7/1990
DE 29717295 U1 * 1/1999

(Continued)

OTHER PUBLICATIONS

PCT/EP2010/004599, International Search Report issued Dec. 30, 2010.

*Primary Examiner* — Mary McManmon
(74) *Attorney, Agent, or Firm* — Robert R. Deleault, Esq.; Mesmer & Deleault, PLLC

(57) ABSTRACT

A household appliance light emitting device has a light diode that emits a light beam having a cross-section area and a light deflection device through which the light beam travels and that deflects the entering light beam such that the light beam exits asymmetrically to the optical axis of the household appliance light emitting device from the light deflection device. The light deflection device is designed integrally with a housing where the light diode is arranged.

12 Claims, 4 Drawing Sheets

Figure 1:
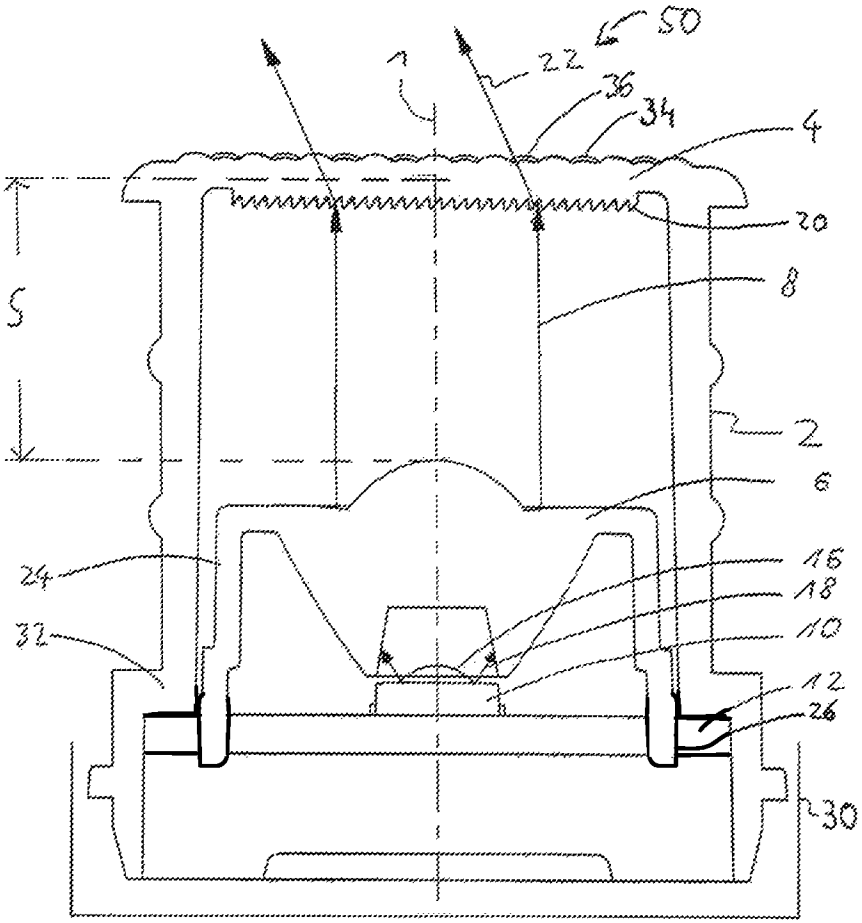

(51) Int. Cl.

| | |
|---|---|
| ***F21V 13/02*** | (2006.01) |
| ***F21V 31/00*** | (2006.01) |
| ***F21V 33/00*** | (2006.01) |
| *F21V 17/06* | (2006.01) |
| *F21V 17/16* | (2006.01) |
| *F21V 19/00* | (2006.01) |
| *F21W 131/30* | (2006.01) |
| *F21Y 101/02* | (2006.01) |

(56) References Cited

U.S. PATENT DOCUMENTS

| | | | | |
|---|---|---|---|---|
| 5,947,587 | A * | 9/1999 | Keuper et al. | 362/235 |
| 6,019,493 | A * | 2/2000 | Kuo et al. | 362/335 |
| 6,561,690 | B2 * | 5/2003 | Balestriero et al. | 362/555 |
| 6,599,002 | B2 * | 7/2003 | Hsieh et al. | 362/555 |
| 6,864,513 | B2 * | 3/2005 | Lin et al. | 257/99 |
| 6,948,838 | B2 * | 9/2005 | Kunstler | 362/545 |
| 6,981,784 | B2 * | 1/2006 | Dubuc | 362/331 |
| 7,559,672 | B1 | 7/2009 | Parkyn et al. | |
| 7,909,494 | B2 * | 3/2011 | Chung et al. | 362/545 |
| 8,157,414 | B2 * | 4/2012 | Schaefer et al. | 362/245 |
| 2002/0034081 | A1 * | 3/2002 | Serizawa | 362/540 |
| 2006/0092636 | A1 * | 5/2006 | Potucek et al. | 362/244 |
| 2006/0139942 | A1 * | 6/2006 | Pond et al. | 362/545 |
| 2007/0030688 | A1 * | 2/2007 | Amano et al. | 362/521 |
| 2007/0147041 | A1 * | 6/2007 | Shiratsuchi et al. | 362/268 |
| 2007/0274084 | A1 | 11/2007 | Kan et al. | |
| 2008/0053161 | A1 * | 3/2008 | Dahlke et al. | 68/13 R |
| 2008/0218993 | A1 * | 9/2008 | Li | 362/84 |
| 2009/0116243 | A1 | 5/2009 | Condon et al. | |
| 2010/0033949 | A1 * | 2/2010 | Hering et al. | 362/91 |
| 2010/0246176 | A1 * | 9/2010 | Shyu et al. | 362/235 |
| 2011/0267823 | A1 * | 11/2011 | Angelini et al. | 362/277 |

FOREIGN PATENT DOCUMENTS

| | | | |
|---|---|---|---|
| DE | 102005055774 | B3 * | 2/2007 |
| DE | 102007053558 | A1 | 5/2009 |
| DE | 102011075068 | A1 * | 11/2012 |
| EP | 1048775 | A1 * | 11/2000 |

* cited by examiner

LIGHT EMITTING DEVICE FOR A DRUM OF A HOUSEHOLD APPLIANCE

The present invention relates to a light-emitting device for illuminating the drum of a household appliance, and also to a household appliance having such a light-emitting device.

A light-emitting device pertaining to the state of the art includes a housing with a light-emergence region and with a fastening region remote from and opposite said light-emergence region. The light-emitting device is fastened on the fastening region to a component of a household appliance. Furthermore, the cables for supplying power to a light-emitting diode of the light-emitting device enter the light-emitting device in the vicinity of the fastening region. The light-emitting diode is arranged in the vicinity of the light-emergence region. To this end, metal components and/or plastic components are provided in the state of the art, with which a light-emitting diode can be arranged in the vicinity of the light-emitting region. These metal components and/or plastic components support the light-emitting diode in relation to the fastening region. Since the light-emitting diode is typically arranged on a printed circuit board, relatively many components are required in order to support the light-emitting diode with the printed circuit board in relation to the fastening region. In this connection the supply of power may be undertaken via suitably supplied cables or via metal components. Moreover, with such a light-emitting device pertaining to the state of the art relatively many assembly steps are required.

Combinations are known in the state of the art consisting of light-emitting diodes with a relatively small aperture angle, i.e. about 3° to 10°, and a diffuser. Such a combination has the drawback that the intensity maximum of the emission of light is subject to relatively large variation. That is to say, the maximum of the emission of light of a light-emitting diode may exhibit a relatively large deviation from the mechanical axis of the light-emitting diode. This leads to an uneven illumination of the diffuser, resulting in an uneven emission of light of the combination of diffuser and light-emitting diode. Since the emission of light of the light-emitting diode takes place only within a relatively narrow angular range, assembly tolerances of the light-emitting diode have a strong effect on the position and the intensity of the light incident on the diffuser. This means that a relatively slight misorientation of the light-emitting diode is already sufficient for the diffuser to be unevenly illuminated by the light-emitting diode and for the emission of light from the diffuser to occur unevenly.

A further problem arises if the drum of a household appliance, for example of a washing machine or of a tumble dryer, is to be illuminated, since no lighting means can be arranged within the drum or in front of the drum, as a supply of power to a lighting means arranged on a rotating drum can only be realised with considerable effort, and lighting means arranged in front of the drum would impair visibility into the drum.

It is an object of the invention to create an improved light-emitting device for illuminating a drum of a household appliance.

The object of the invention is achieved by a household-appliance light-emitting device with a light-emitting diode, which emits a light beam having a cross-section, with a housing, in which the light-emitting diode is arranged, and with a light-guiding device, through which the light beam passes and which deflects the entering light beam in such a way that the light beam emerges from the light-guiding device asymmetrically with respect to the optical axis of the household-appliance light-emitting device, the light-guiding device being integrally formed with the housing.

The term 'light beam' as used herein also encompasses a bundle of individual rays. The midpoint of the light-emitting region of the light-emitting diode may be located on the optical axis of the household-appliance light-emitting device. Furthermore, the midpoint of the light-guiding device may be located on the optical axis of the household-appliance light-emitting device. The light deflected by the light-guiding device is preferentially emitted obliquely with respect to the optical axis of the household-appliance light-emitting device. The household-appliance light-emitting device preferentially includes an orientation feature, for example a recess or a projection, which is arranged on the housing in a fixed orientation with respect to the light beam which is emitted asymmetrically with respect to the optical axis.

By virtue of the emission of a light beam asymmetrically with respect to the optical axis of the light-emitting device, novel construction techniques in the field of household appliances are made possible. The light-emitting device according to the invention may be used, in particular, for illuminating a drum of a household appliance, for example of a washing machine, mentioned in the introduction, or of a tumble dryer. In the case of a washing machine, a seal is ordinarily arranged between a tub, in which the drum is located, and the housing. The seal seals the gap between the drum and the housing. For structural-design reasons, this gap should be kept as small as possible. The light-emitting device, in particular the optical axis thereof, may have been arranged in the tub between the drum and the housing, perpendicular to the axis of rotation of the drum. The light-emitting device according to the invention may alternatively be arranged in the seal in the gap between the housing and the drum, parallel to the axis of rotation of the drum. By virtue of the oblique emission of light of the light-emitting device, i.e. asymmetrical with respect to the optical axis of the light-emitting device, it is ensured that the drum can be illuminated. By virtue of the orientation feature on the light-emitting device it is ensured that the light-emitting device is arranged on the household appliance with such an orientation that the oblique light beam emitted from the light-emitting device impinges, at least for the most part, into the drum. For this purpose, complementary orientation features may have been provided on the household appliance. If a plurality of light-emitting devices are to be arranged in the region of the opening of the drum around the axis of rotation of the drum, it will be understood that the complementary orientation features each exhibit such an angle that it is ensured that the light beam emitted asymmetrically with respect to the optical axis of the respective light-emitting device impinges into the drum.

Since the axial direction and/or the optical axis of the light-emitting device is/are located parallel to the axis of rotation of the drum, the gap and consequently also the seal can be kept as small as possible. If a light-emitting device that emits a light beam parallel to and/or along its optical axis is provided for the purpose of illuminating a drum, the light-emitting device has to be arranged obliquely in the gap with respect to the tub, requiring a larger gap or reducing possible required tolerances.

The intensity maximum of the light beam emitted from the light-guiding device exhibits an angle from about 20° to about 70°, preferentially from about 30° to about 60°, most preferentially from about 35° to about 55°, relative to the optical axis of the light-emitting device.

The household-appliance light-emitting device may exhibit a plurality of light-emitting diodes, the light of which passes through the light-guiding device. The light-guiding device deflects substantially all the individual rays of the light beam of the light-emitting diode in the same direction asymmetrically with respect to the optical axis of the household-appliance light-emitting device. The light emitted from the light-emitting diode consequently emerges from the household-appliance light-emitting device obliquely with respect to the optical axis of said household-appliance light-emitting device.

The light-guiding device includes at least one prism-type element, preferentially a plurality of prism-type elements, in order to deflect the light beam of the light-emitting diode asymmetrically with respect to the optical axis of the light-emitting device. The light beam consequently emerges from the light-emitting device at an oblique angle with respect to an axis that is perpendicular to the region of the housing from which the light beam emerges from the light-emitting device and/or that is located parallel to the longitudinal axis of the housing. The light-emission plane of the light-emitting diode is preferentially arranged parallel to the light-guiding device.

The at least one prism-type element may have been arranged on the side of the light-guiding device facing towards the light-emitting diode. A plurality of prism-type elements have preferentially been arranged on the side of the light-guiding device facing towards the light-emitting diode. As a result, a particularly low height of the light-guiding device is obtained.

The at least one prism-type element may have been aligned asymmetrically with respect to the optical axis of the household-appliance light-emitting device. In particular, the at least one prism-type element may have been designed to be rotationally asymmetrical with respect to the optical axis of the household-appliance light-emitting device. At least one linear prism-type element may have been provided, the longitudinal axis of which extends in a plane perpendicular to the optical axis of the household-appliance light-emitting device. At least one prism-type element may have been designed in the form of an arc segment and to be asymmetrical, in particular rotationally asymmetrical, with respect to the optical axis of the household-appliance light-emitting device.

On the side of the light-guiding device facing away from the light-emitting diode at least one light-homogenising means, preferentially at least a plurality of homogenising means, may have been arranged, which ensure that the beam emitted from the light-emitting device exhibits a defined angular spectrum.

The light-emitting diode may emit the light beam with a first angular spectrum, and the household-appliance light-emitting device may exhibit a light-bunching device arranged spatially between light-emitting diode and light-guiding device, which changes the light beam from the light-emitting diode into a light beam with a second angular spectrum, the second angular spectrum being smaller than the first angular spectrum. The light beam can propagate across a section from the light-bunching device to the light-guiding device.

It is possible that the light-bunching device generates a convergent or divergent bundle of light beams. The light-bunching device concentrates the beams emitted from a light-emitting diode into a bundle that exhibits a substantially lower angular spectrum than the light emitted from the light-emitting diode.

The light-bunching device is preferentially a light-parallelising device. The light beam with the second angular spectrum is preferentially a substantially parallel light beam. The light beam with the second angular spectrum may have an aperture angle (i.e. an angular deviation from parallelism) less than or equal to about ±10°, about ±5°, preferentially of about less than or equal to ±2.5°, preferentially of about ±1° and most preferentially of less than or equal to about ±0.5°. At the edge of the angular spectrum the intensity of the light beam may amount to 50% of the maximal intensity. This definition is typically used for determining the angular spectrum of a light-emitting diode. If a different definition is used for the determination of the angular spectrum of the light-emitting diode, the intensities at the edge of the respective angular spectrum also consequently change. The light-bunching device may exhibit a diameter between about 10 mm and about 20 mm.

Since the light beam with the second angular spectrum is conducted from the light-bunching device to the light-divergence device and since the second angular spectrum is smaller than the first angular spectrum, the light-guiding device may have been spaced from the light-bunching device without substantial losses of intensity arising. Since the light beam with the second angular spectrum passes through a section between the light-bunching device and the light-guiding device, no coupling-in or coupling-out losses arise such as occur, for example, in optical waveguides. The light-emitting diode and the light-bunching device may have been arranged close to a fastening region of the light-emitting device opposite the light-guiding device. This has the advantage that no or only few additional plastic components and metal components are required in order to fasten the light-emitting diode, which is placed, for example, on a circuit board, to the fastening region. The light emerging from the light-emitting diode is changed by the light-bunching device into a light beam with the second, smaller and preferentially parallel angular spectrum, which passes across a section to the relatively distant light-guiding device where it is changed into a light beam that emerges from the light-emitting device asymmetrically with respect to the optical axis thereof.

The cross-sectional area of the light beam with a second angular spectrum may be greater than the luminous surface of the chip of the light-emitting diode. As a result, tolerances of position and angle between the light-bunching device, the light-emitting diode, the chip in the light-emitting diode, a soldered joint between the light-emitting diode and the circuit board and also assembly tolerances between the circuit board and the fastening region act less strongly on the position and orientation of the light beam with the second, smaller and preferentially parallel angular spectrum. Typically the light-emitting diode exhibits a lens, in which case the first angular spectrum of the light emerging from the light-emitting diode exhibits a range from about 20° to about 130°, preferentially about 50° to about 130°, most preferentially about 110° to about 130°. The angular spectrum may be defined in such a manner that the intensity of the light at the edge of the angular spectrum amounts to about 50% of the maximal intensity, as is customary with light-emitting diodes. A large angular spectrum of the light beam emitted from the light-emitting diode permits greater assembly tolerances between the light-bunching device, the light-emitting diode, the chip in the light-emitting diode, the lens in the light-emitting diode, the soldered joint between the light-emitting diode and the circuit board and also between the circuit board and the fastening region, without the quality of the light beam with the second, smaller and preferentially parallel angular spectrum being too greatly impaired thereby.

The light-bunching device may have been sealed in relation to the housing. For this purpose, an O-ring, for example, may have been arranged between the housing and the light-bunching device. In this case the light-emitting device exhibits redundancy and may be classified in a higher protection class.

Furthermore, this light-emitting device permits simple cabling, since the circuit board is arranged in the vicinity of the fastening region, from where power is supplied to the light-emitting device.

The light-emitting diode is preferentially an SMD light-emitting diode which is fastened to a circuit board by soldering. Since the light-emitting device according to the invention is relatively tolerant towards manufacturing tolerances, the positioning of the light-emitting diode can be effected by soldering. Furthermore, depending upon the soldering method, a centring of the SMD light-emitting diode on the terminals of the circuit board is effected. SMD light-emitting diodes typically exhibit a large angular spectrum, i.e. a large aperture angle, between about 50° and about 120°. For the described application the invention provides that the light-bunching device generates a divergent or convergent light beam with the second angular spectrum which amounts to about ±15°, preferably about ±10°, more preferably about ±5°, most preferably about ±1.5°.

The household-appliance light-emitting device may exhibit a plurality of light-emitting diodes, in which case the light-bunching device changes the light of the plurality of light-emitting diodes into a light beam with the second, smaller and preferentially parallel angular spectrum. As a result, a particularly bright and/or redundant light-emitting device for a household appliance arises. The light lobes of the light-emitting diodes preferentially overlap when they are incident on the light-bunching device.

The light-bunching device may be a collective lens, in particular a Fresnel lens. The light-bunching device may be a collimator. The spacing between the light-bunching device and the light-guiding device may be greater than or equal to about 5 mm, preferentially greater than or equal to about 7.5 mm, and most preferentially greater than or equal to about 10 mm. The cross-section of the light beam with the second, smaller and preferentially parallel angular spectrum amounts to about 3 mm to about 20 mm, preferentially about 5 mm to about 15 mm, most preferentially about 8 mm to about 12 mm. The angular spectrum of the light beam emerging from the light-emitting device amounts to about 20° to about 60°, preferentially about 30° to about 50°, most preferentially about 35° to about 50°.

The light-bunching device and the circuit board may have been spatially fixed to one another. As a result, the tolerance chain, described in the introduction, for the light beam with the second, smaller and preferentially parallel angular spectrum is reduced to the position tolerance of the chip of the light-emitting diode, of the lens of the light-emitting diode, of the light-emitting diode with respect to the circuit board and of the circuit board with respect to the light-bunching device. The light-bunching device and the circuit board may have been fastened together. The circuit board may exhibit recesses, in which projections of the light-bunching device engage. The recesses may be located at the edge of the circuit board or may take the form of openings. The projections of the light-bunching device may be arms. Detent means may have been formed on the arms. The circuit board may have been arranged in the light-bunching device.

The light-bunching device may have been spatially fixed in relation to a housing of the light-emitting diode, in particular by the light-bunching device exhibiting a region complementary to the housing of the light-emitting diode, which spatially fixes the light-bunching device in relation to the light-emitting diode. The light-bunching device may exhibit a housing that on its region facing towards the circuit board exhibits a recess complementary to the housing of the LED. Consequently the housing of the light-bunching device may be positioned above the housing of the LED, and the housing of the LED fixes the housing of the light-bunching device spatially. The complementary region may abut the entire housing of the light-emitting diode, or it may abut the housing of the light-emitting diode merely at four points or two corners. By this means, the tolerances caused by the circuit board can be eliminated.

The circuit board may have been arranged on the housing of the household-appliance light-emitting device in such a way that the position of the circuit board in the direction of the optical axis of the household-appliance light-emitting device and/or perpendicular to the direction of the optical axis of the household-appliance light-emitting device is fixed by the housing of the household-appliance light-emitting device. As a result, the position of the circuit board and hence the position of the light-emitting diode, inclusive of the chip and the lens, and the position of the light-bunching device with respect to the housing of the household-appliance light-emitting device can be fixed relatively precisely. If the light-guiding device has been integrally formed with the housing of the household-appliance light-emitting device, in this embodiment the tolerances of the tolerance chain can be reduced further, and an emission of light results that is subject to relatively low manufacturing variations.

The housing of the household-appliance light-emitting device may exhibit a first region with a first cross-section and a second region with a second cross-section, in which case the first region exhibits a smaller cross-section than the second region, a stepped transition is present between the first and second regions, the circuit board and the light-bunching device are fixed by the second zone perpendicular to the optical axis of the household-appliance light-emitting device, and the stepped transition fixes the circuit board and the light-bunching device in the direction of the optical axis. Since the light-guiding device is integrally formed with the housing of the household-appliance light-emitting device, this embodiment is particularly suitable for a casting process.

In an alternative embodiment the circuit board may have been arranged on a cover. The cover may have been fastened to the housing, for example by means of a latching method, opposite the light-guiding device. The lens may, as previously described, have been arranged on the circuit board. In this embodiment, size deviations of the circuit board, which may amount to ±0.15 mm for example, can be compensated, since the circuit board does not abut the housing. The size tolerance of the circuit board may consequently not result in a jamming of the circuit board in the housing, in a deformation of the housing, or in a play of the circuit board in the housing.

The invention also relates to a household-appliance seal arrangement that exhibits an elastic seal with at least one receptacle, and to a household-appliance light-emitting device. The household-appliance seal arrangement may have been arranged in the tub of a washing machine and may seal the drum in relation to the housing. The receptacle receives a region of the housing of the household-appliance light-emitting device opposite the light-emitting diode. The receptacle may be a recess in the seal. The region of the housing opposite the light-emitting diode is advantageously formed with a circular cross-section, in order to bring about a sealing effect that is as good as possible in interplay with the preferentially elastic seal. The seal arrangement according to the invention has the advantage that the waste heat of the light-emitting diode is not conducted into the seal or is only conducted into the seal to a slight extent, increasing the life of the seal. By virtue of the thermal load by reason of the waste heat of the light-emitting diode, the life of the seal may be shortened. Furthermore, the printed circuit board may be constructed in an arbitrary shape, for example rectangular, and does not necessarily have to be circular, which would be the case if the light-emitting diode light were arranged on the light-emergence aperture.

The recess in the seal may have been formed as an opening or as a blind hole which receives the region of the housing of the household-appliance light-emitting device opposite the light-emitting diode. By virtue of the blind hole in the seal, a particularly reliable household-appliance seal arrangement is created. In this case the seal should be formed, at least in the region of the receptacle or of the blind hole, from a semitransparent or transparent material. The seal may have been designed to be non-transparent in a region remote from the receptacle or from the blind hole.

The invention also relates to a household appliance, for example a washing machine or a tumble dryer, with the previously described household-appliance seal arrangement. The household-appliance seal arrangement may have been arranged on a drum of the household appliance. In such a household appliance, on the one hand the drum can be illuminated well, and on the other hand the dimension of the gap between the drum and the housing can be kept small. The household-appliance light-emitting device may be used in an arbitrary household appliance, for example in a cooker for the purpose of illuminating the oven.

The light-guiding device may be a light-deflecting device or a light-directing device.

Figure 2:
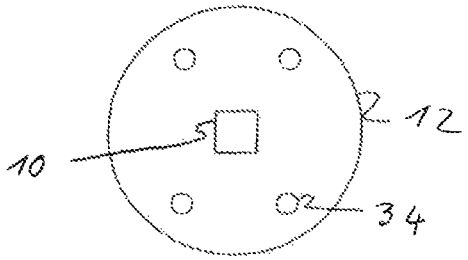
Figure 3:
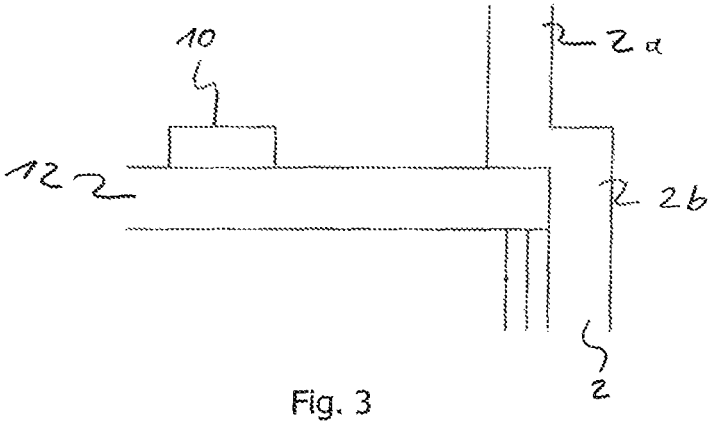
Figure 4:
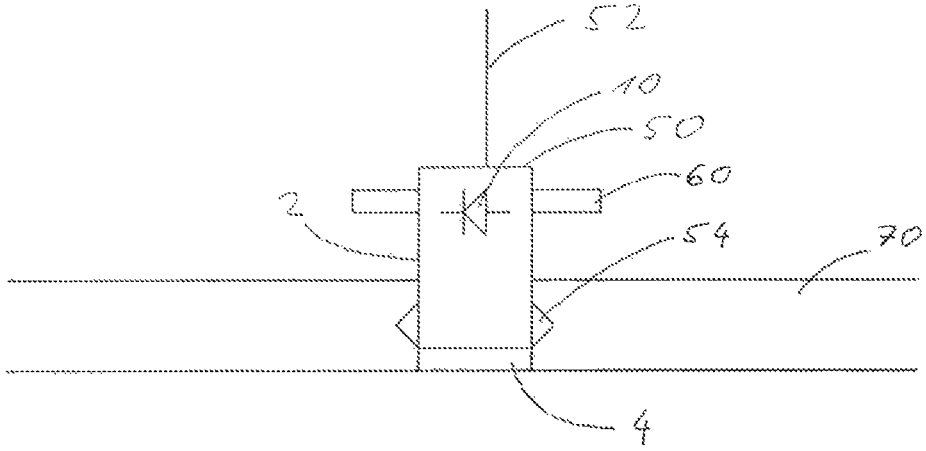

The invention will now be described in more detail with reference to the appended drawings, wherein:

FIG. 1 is a schematic section through a household-appliance light-emitting device according to the invention, FIG. 2 is a schematic top view of a circuit board of the household-appliance light-emitting device, FIG. 3 is a section through the housing and the circuit board of the household-appliance light-emitting device and FIG. 4 is a section through a seal with a household-appliance light-emitting device.

Figure 5:
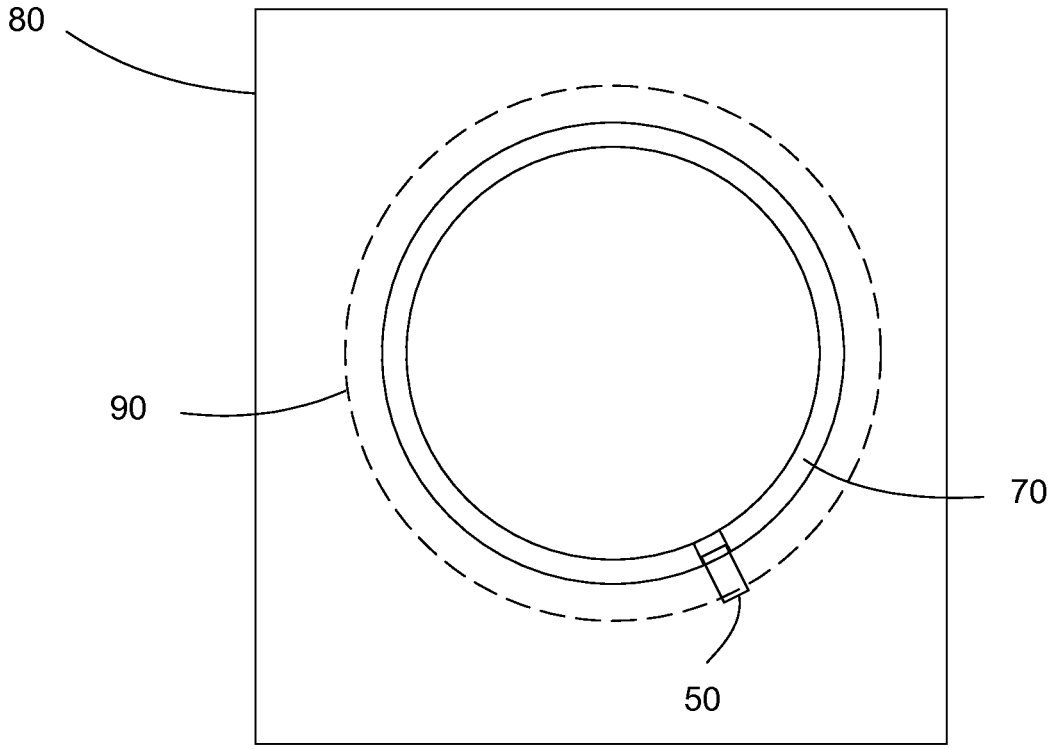

FIG. 5 is a schematic front view of a household appliance showing a housing, a drum, and a seal.

The light-emitting device 50, described below, for a household appliance may be used in order to illuminate the drum or other rotating components of a household appliance, for example of a washing machine or of a tumble dryer.

Reference will be made to FIG. 1. The light-emitting device 50 exhibits a housing 2 in which a circuit board 12 with a light-emitting diode 10 is arranged. The light-emitting device 50 is closed with a cover 30. The light-emitting device 50 may have been fastened—that is to say, spatially fixed—to a household appliance by means of the housing 2 or by means of the cover 30. A chip (not shown) of the light-emitting diode 10 emits light which is brought by a lens 16 of the light-emitting diode 10 into a predetermined angular spectrum, for example about 120°. The angular spectrum of the light-emitting diode may have been defined in such a way that the intensity at the edge of the angular spectrum amounts to 50% of the maximal intensity. The light beams 18 with the relatively large angular spectrum emerging from the lens 16 of the light-emitting diode 10 are incident on a collective lens 6. The collective lens 6 functions as a light-bunching device or light-parallelising device. The collective lens 6 generates substantially parallel light beams 8. The intensity spectrum of the substantially parallel light beam may also have been defined in such a way that the intensity at the edge of the angular spectrum amounts to 50% of the maximal intensity. This substantially parallel light beam 8 passes through the hollow housing 2. The substantially parallel light beam 8 is incident on a light-guiding device 4. For this purpose the substantially parallel light beam 8 passes across a section S which is approximately as long as the diameter of the beam in this region, or longer. The term 'substantially parallel light beam' 8 may encompass a light beam that, for example by reason of manufacturing tolerances and/or assembly tolerances, also slightly converges or diverges, for example converges or diverges by about ±10°. The aperture angle of the light beam 22 emerging from a light-guiding device 4 may amount, for example, to about 20° to about 60°, in which case the light-guiding device 4 deflects the beam 22 asymmetrically with respect to the optical axis 1 of the light-emitting device 50. In the case of an inexpensive mass-produced article of such a type the tolerances are relatively high. If the light beam emerging from the light-guiding device exhibits a relatively large aperture angle, the expression 'asymmetrically with respect to the optical axis' is to be understood in such a way that the intensity maximum of the light beam emerging from the light-guiding device is located asymmetrically with respect to the optical axis of the light-emitting device. A transparent cylinder or another light-conducting element may have been arranged within the section S.

On its side facing towards the light-emitting diode (i.e. a wall inner face), the light-guiding device 4 exhibits a plurality of prism-type elements 20. By means of a prism-type element a light beam incident thereon is refracted with respect to the perpendicular of the surface on which the light beam is incident. Since the surfaces of the prism-type elements 20 onto which light beams are incident exhibit approximately the same angle with respect to the optical axis 1 of the light-emitting device, all the beams are deflected substantially in the same direction, to the extent that they are incident on the prism-type element at the same angle. Since a plurality of prism-type elements are provided, the light-guiding device can be formed with a relatively slight thickness. It is also possible to provide a smaller number of prism-type elements or even only one prism-type element, though as a result of this the thickness of the light-guiding device 4 increases.

In the embodiment represented, the prism-type elements 20 are formed not in rotationally symmetrical manner but linearly. FIG. 1 is consequently a section through a plurality of linearly formed prism-type elements 20 of a light-guiding device 4 shown. These linear prism-type elements 20 extend, for example, perpendicular to the section plane through the light-emitting device. The prism-type elements are preferentially linear prisms. The linear prism-type elements 20 are located in a plane that is arranged perpendicular to the optical axis 1 of the light-emitting device 50. The intensity maximum of the light beam 22 emitted from the light-guiding device 4 exhibits an angle from about 20° to about 70°, preferentially from about 30° to about 60°, most preferentially from about 35° to about 55°, relative to the optical axis 1 of the light-emitting device. The beams 8 and 22 represented in the Figure represent merely exemplary beams and are not to be understood as boundary-value beams or as beams, the intensity of which amounts to one half of the magnitude of the intensity maximum.

On the side of the light-guiding device 4 facing away from the light-emitting diode 10 (i.e. a wall outer face), a plurality of homogenising means 34, 36 are arranged. In the embodiment being described here, light-homogenising means of a first type 34 and of a second type 36 are provided. The homogenising means 34, 36 may take the form of collective lenses and/or dispersive lenses. The homogenising means 34, 36 have the effect that the light beam emitted from the light-emitting device exhibits a defined angular spectrum. In this connection the first type of homogenising means 34 exhibits a first radius, and the second type of homogenising means 36 exhibits a second radius, which differs from the first radius. For example, the first type of homogenising means 34 exhibits a radius from about 0.8 mm to about 1.2 mm, and the second type of homogenising means 36 exhibits a second radius from 0.15 mm to about 0.25 mm. The homogenising means 34 of the first type and the homogenising means 36 of the second type may have been arranged in alternating manner with respect to one another. The aperture angle of the light beam emerging from the homogenising means may amount to about 20° to about 60°, preferentially about 30° to about 50°, most preferentially 35° to about 50°. The light-guiding device 4 may exhibit a diameter from about 10 mm to about 20 mm.

The collective lens 6 has been fastened to the circuit board 12 by means of arms 24 with optional snap-in protrusions 26. The circuit board 12 may exhibit openings 34 (see FIG. 2), through which the arms 24 extend.

On the housing 2 there are provided projections 32 which fix the circuit board in its position in the direction of the optical axis of the light-emitting device. The circuit board 12 has an outside diameter that corresponds to the inside diameter of the housing 2 of the light-emitting device, so that the housing 2 fixes the circuit board 12 also in its position perpendicular to the optical axis of the light-emitting device.

Reference will be made to FIG. 2. FIG. 2 shows a top view of the circuit board 12. On the circuit board 12 the light-emitting diode 10 is arranged. Furthermore, the circuit board 12 exhibits openings 34, through each of which an arm 24 may pass.

The collective lens 6 is consequently relatively precisely aligned with the circuit board 12. By use of suitable soldering methods, if use is being made of an SMD light-emitting diode the light-emitting diode 10 is centred on the designated solder pads. As a result, a comparatively precise alignment of the optical axis of the light-emitting diode with the optical axis of the collective lens 6 arises in cost-effective manner. This increases the quality of the emission of light of the household-appliance light-emitting device.

Reference will be made to FIG. 3, which shows a broken-away section in the direction of the optical axis of the light-emitting device through a part of the housing 2 and of the circuit board 12 of the light-emitting device. The housing of the light-emitting device exhibits a first region 2*a* and a second region 2*b*. The first region 2*a* has a smaller cross-section than the second region 2*b*. The cross-section (perpendicular to the optical axis of the light-emitting device) of the housing has a circular, elliptical, rectangular, polygonal shape.

The transition between the first region 2*a* and the second region 2*b* of the housing 2 is stepped. The stepped transition fixes the position of the circuit board 12 in the direction of the optical axis of the light-emitting device. The inside diameter of the second region 2*b* fixes the position of the circuit board 12 perpendicular to the optical axis of the light-emitting device. Preferentially, the light-guiding device 4 is integrally formed with the first region 2*a* or is arranged thereon. Consequently the housing 2 with the two regions 2*a* and 2*b* exhibits no undercuts, so it can be produced by a casting method, for example injection moulding. The inside diameter of the second region 2*b* enables a relatively precise alignment of the circuit board 12 and consequently of the optical axis of the light-emitting diode 10 and of the collective lens 6, as previously described with reference to FIGS. 1 and 2. As a result, the tolerance chain that arises through the addition of the manufacturing tolerances and/or position tolerances of the light-guiding device 4, of the housing 2, of the circuit board 12, of the LED 10, inclusive of chip and lens 16, with respect to the circuit board and also of the collective lens 6 with respect to the circuit board can be reduced.

The collective lens 6 may have been sealed in relation to the housing 2. For this purpose an O-ring (not shown), for example, may have been arranged between the housing 2 and the collective lens 6.

The circuit board 12 is pressed by means of a pressure element (not shown) against the stepped region of the housing 2 of the light-emitting device. Preferentially, the pressure element is integrally formed with the cover 30. The cover 30 can lock in place on the housing 2 by means of a detent lug (not shown).

In another embodiment (not shown) the circuit board may have been arranged on the cover. The cover may have been fastened to the housing, for example by means of a latching method. The lens may, as previously described, have been arranged on the circuit board. In this embodiment, size deviations of the circuit board, which may amount to ±0.15 mm for example, can be compensated, since the circuit board does not abut the housing. The size tolerance of the circuit board may consequently not result in a jamming of the circuit board in the housing, in a deformation of the housing or in a play of the circuit board in the housing. This embodiment has a simpler structure and can be assembled more easily. In this embodiment the cabling is also easier to implement.

Reference will again be made to FIG. 1. The light-emitting device according to the invention has the advantage that it can be produced from few parts that can be produced inexpensively in a casting process. Furthermore, the light-emitting device according to the invention has been designed in such a way that the effects of manufacturing tolerances are as slight as possible. Since the light-emitting diode 10 emits from the lens 16 a light bundle 18 with a relatively large aperture angle, the position tolerance of the light-emitting diode on the circuit board 12 and the position tolerance of the circuit board 12 in relation to the housing 2 have only a relatively slight influence on the quality of the light beam emitted from the light-emitting device. The expression 'position tolerance' relates here also to a tilting of the light-emitting diode 10, of the circuit board, of the chip of the light-emitting diode and/or of the lens 16 of the light-emitting diode. By reason of the large aperture angle of the light bundle 18 emerging from the light-emitting diode 10, the light-emitting device is also tolerant towards tilt tolerances. Even in the event of a tilting and/or displacement of the light-emitting diode 10, of the circuit board 12 of the chip and/or of the lens 16 of the light-emitting diode, a sufficiently wide, substantially parallel light beam arises which is incident onto the light-guiding device 4. The collective lens 6 does not necessarily have to generate a substantially parallel light beam. The light beam generated by the collective lens 6 may converge or diverge. The light beam 22 generated by the light-guiding device 4 may optionally exhibit a substantially greater divergence than the light beam 8 entering the light-guiding device 4.

FIG. 4 shows a household-appliance seal arrangement with a seal 70 and with a household-appliance light-emitting device 50 which is arranged in a receptacle of the seal 70 taking the form of a recess. The recess in the seal 70 receives the region of the housing 2 of the household-appliance light-emitting device 50 opposite the light-emitting diode 10. The recess of the seal 70 consequently receives the region of the housing 2 of the light-emitting device 50 in which the light-guiding device 4 is located. Since the light-emitting diode 10 of the light-emitting device 50 is relatively far away from the seal 70, no waste heat or only relatively little waste heat generated by the light-emitting diode 10 is conducted into the seal 70. By this means, the life of the seal can be increased.

The housing 2 of the light-emitting device 50 may exhibit at least one pointed sealing element 54 projecting away from the housing 2, which, on the one hand, fixes the light-emitting device 50 in its position in relation to the seal and prevents a liquid from passing through the seal 70 in the region of the recess. Furthermore, optional fastening means 60 are provided which fix the light-emitting device 50 in its position in relation to a household appliance and/or which dissipate heat generated by the LED. The light-emitting device is supplied with power via a cable 52.

The household-appliance seal arrangement shown in FIG. 4 exhibits a recess in the form of an opening in the seal 70. Alternatively, the recess may also take the form of a blind hole in which the light-emitting device 50 is arranged. In this embodiment the entire seal 70 may have been designed to be transparent, or merely the region of the recess and optionally the environment thereof may have been designed to be transparent. This embodiment has the advantage that a particularly reliable sealing arrangement is created. The term 'receptacle' as used herein encompasses not only an opening or a blind hole in the seal 70. It is also possible to keep the thickness of the seal 70 substantially constant, and to provide on one side of the seal 70 a receptacle which receives the region of the housing 2 of the household-appliance light-emitting device 50 opposite the light-emitting diode 10. This receptacle may exhibit, for example, a U-shaped cross-section. Also in this case the seal must have been designed to be semi-transparent or transparent in the region of the receptacle, whereas it may be non-transparent in a region remote from the receptacle.

FIG. 5 shows a household appliance 80 with a drum 90 and a seal 70. Within the seal 70 is a recess 72 in which a portion of the light-emitting device 50 is positioned such that the light-guiding device 4 disperses the light beam into the drum 90.

The invention claimed is:

1. In combination, a household appliance and a light-emitting device comprising:

a household appliance having a rotatable drum and a seal adapted to seal the drum with respect to a housing of the household appliance, the seal having a recess; and a light-emitting device disposed to illuminate an interior of the drum, the light-emitting device comprising:

a housing defining an axis and having a light-guiding device in the region of a first axial end portion of the housing, the light-guiding device being integrally formed with the housing and having a wall inner face facing an interior of the housing and a wall outer face opposite the wall inner face, wherein at least a portion of the housing including the light-guiding device is inserted into the recess of the seal;

a light-emitting diode disposed in the housing and adapted to emit a light beam having a first angular spectrum; and a converging lens member disposed between the light-emitting diode and the light-guiding device and adapted to change the light beam from the light-emitting diode into a light beam having a second angular spectrum, the second angular spectrum being smaller than the first angular spectrum, wherein the light-guiding device is adapted to deflect the light beam from the converging lens member as the light beam travels through the light-guiding device so that the light beam emerges from the wall outer face of the light-guiding device asymmetrically with respect to the axis of the housing.

2. The combination according to claim 1 wherein at least one of the wall inner face and the wall outer face is provided with a plurality of prism-type elements arranged in a rotationally asymmetrical manner with respect to the axis of the housing.

3. The combination according to claim 2 wherein the plurality of prism-type elements is linearly formed and extends in a plane perpendicular to the axis of the housing.

4. The combination according to claim 2 wherein the plurality of prism-type elements are formed at the wall inner face of the housing.

5. The combination according to claim 1 further comprising a plurality of homogenising members formed at the wall outer face of the housing.

6. The combination according to claim 1 wherein the converging lens member is sealed in relation to the housing.

7. The combination according to claim 1 wherein the light-guiding device is adapted to deflect the beam by about 20° to about 70° asymmetrically with respect to the axis of the housing.

8. The combination according to claim 1 comprising a circuit board accommodated in the housing, wherein the light-emitting diode and the converging lens member are mounted on the circuit board.

9. The combination according to claim 1 wherein the light-guiding device is adapted to deflect the beam by about 30° to about 60° asymmetrically with respect to the optical axis of the housing.

10. The combination according to claim 1 wherein the light-guiding device is adapted to deflect the beam by about 35° to about 55° asymmetrically with respect to the axis of the housing.

11. The combination according to claim 1 wherein the axis of the housing is parallel to an axis of rotation of the drum.

12. A method of assembling a light-emitting device to a household appliance, the method comprising:

providing a household appliance having a rotatable drum and a seal adapted to seal the drum with respect to the housing of the household appliance, the seal having a recess;

providing a light-emitting device adapted to illuminate an interior of the drum, the light-emitting device comprising:

a housing defining an axis and having a light-guiding device in the region of a first axial end portion of the housing, the light-guiding device being integrally formed with the housing and having a wall inner face facing an interior of the housing and a wall outer face opposite the wall inner face;

a light-emitting diode disposed in the housing adapted to emit a light beam having a first angular spectrum; and a converging lens member disposed between the light-emitting diode and the light-guiding device and adapted to change the light beam from the light-emitting diode into a light beam having a second angular spectrum, the second angular spectrum being smaller than the first angular spectrum, wherein the light-guiding device is adapted to deflect the light beam from the converging lens member as the light beam travels through the light-guiding device so that the light beam emerges from the wall outer face of the light-guiding device asymmetrically with respect to the axis of the housing;

inserting the light-emitting device in the recess of the seal wherein at least a portion of the housing of the light-emitting device including the light-guiding device is inserted into the recess.

* * * * *